US005088301A

United States Patent [19]

Piepenbrink

[11] Patent Number: 5,088,301

[45] Date of Patent: Feb. 18, 1992

[54] NESTABLE COOLING BOWL

[76] Inventor: Joseph J. Piepenbrink, 714 Lincoln, McHenry, Ill. 60050

[21] Appl. No.: 631,970

[22] Filed: Dec. 21, 1990

[51] Int. Cl.[5] ..... F25D 3/08

[52] U.S. Cl. ..... 62/457.6; 62/457.1

[58] Field of Search ..... 62/457.1, 457.6, 457.2, 62/457.3, 457.4, 371, 1; 126/400

[56] References Cited

U.S. PATENT DOCUMENTS

| | | | |
|---|---|---|---|
| 235,300 | 6/1975 | Mountain, Jr. et al. | D. 7/38 |
| 301,820 | 6/1989 | Wasserman | 62/457.6 |
| 1,659,530 | 2/1928 | Jefferies | 62/371 |
| 1,954,728 | 4/1934 | Dolan | 62/457.2 |
| 2,652,698 | 9/1953 | Schlumbohm | 62/457.1 |
| 2,667,422 | 1/1954 | Kauffman | 62/371 |
| 2,777,626 | 1/1957 | French | D. 7/38 |
| 3,429,141 | 2/1969 | Halseth | 62/457.1 |
| 4,520,633 | 6/1985 | Hoydic | 62/457.6 |
| 4,567,877 | 2/1986 | Sepahpur | 126/400 |
| 4,642,999 | 2/1987 | Justice | 62/457.4 |
| 4,982,722 | 1/1991 | Wyatt | 126/400 |

FOREIGN PATENT DOCUMENTS

| | | |
|---|---|---|
| 1126304 | 9/1968 | United Kingdom . |
| 2078095 | 1/1982 | United Kingdom . |

*Primary Examiner*—Albert J. Makay
*Assistant Examiner*—William C. Doerrler
*Attorney, Agent, or Firm*—Mathew R. P. Perrone, Jr.

[57] ABSTRACT

A cooling device includes a reusable cooling member, which may be assembled when in use, and disassembled into nestable parts when desired to be refrozen or cooled. The cooling member may be inserted into an insulated container when in use.

12 Claims, 7 Drawing Sheets

FIG. 2
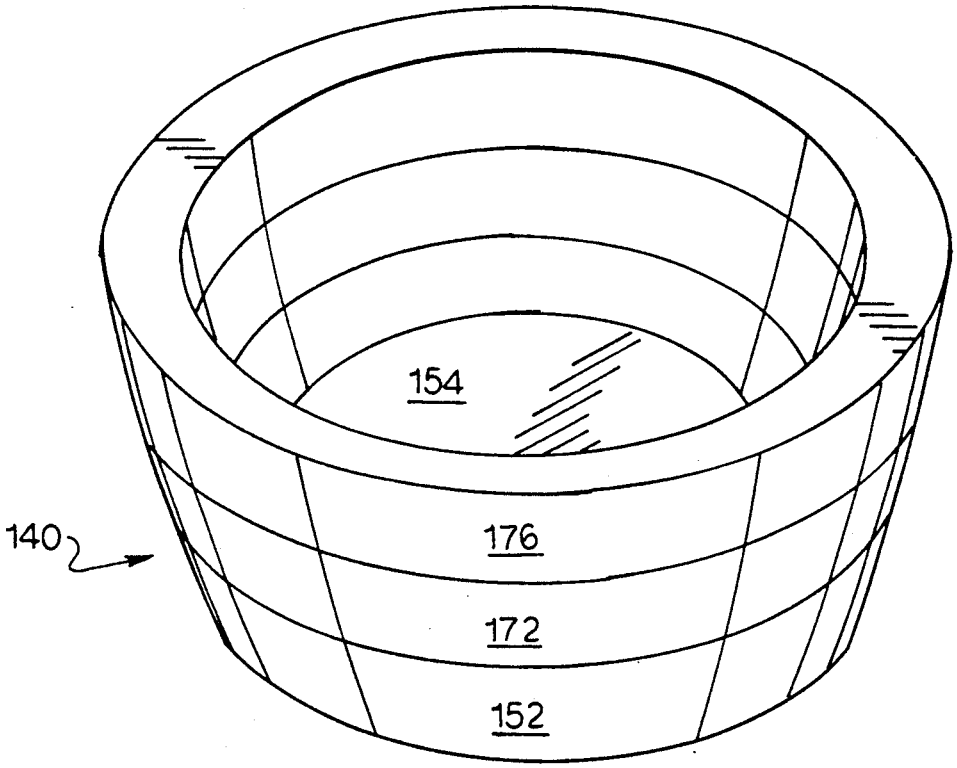
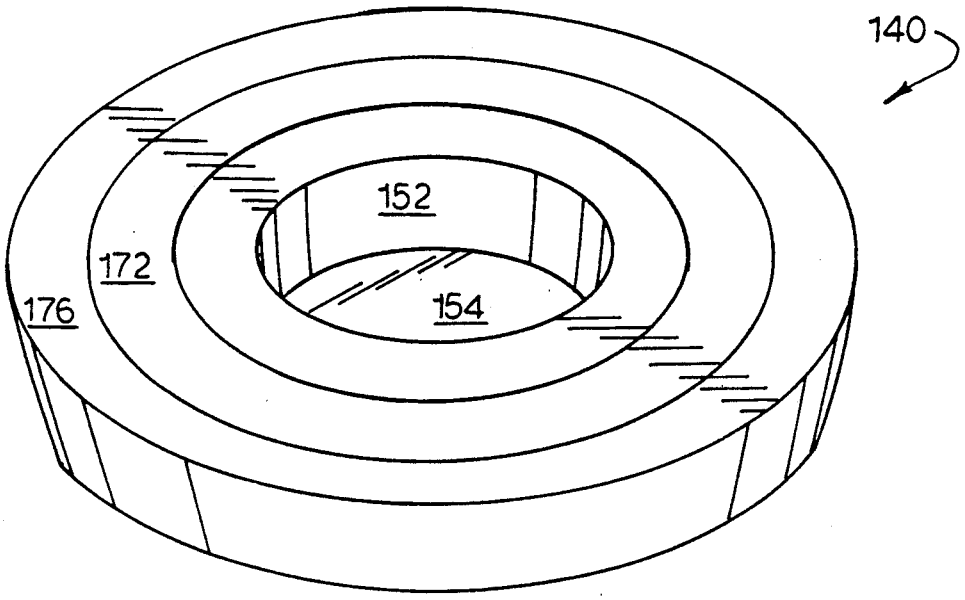
FIG. 8

NESTABLE COOLING BOWL

This invention relates to a cooling device, and more particularly to a self-contained, cooling device which maintains its cooling capabilities after removal from an electro-mechanical refrigerator or freezer.

BACKGROUND OF THE INVENTION

It is always a problem to keep fresh foods requiring refrigeration cold especially when a refrigerator device is not available. It is highly difficult to make the refrigerator device portable. An electro-mechanical refrigerator device is too heavy, and additionally requires a power source, which also adds to the weight thereof, so as to minimize portability.

A disposable refrigerant cannot accomplish the desired refrigeration. Ice does melt and can cause difficulty in keeping an area appropriately clean—among other problems. Frozen carbon dioxide (commonly known as dry ice), while eliminating the water problem, is too bulky, which adds to the difficulty of carrying the portable refrigerator.

Reusable refrigerants and containers therefor do not solve the problem when the item to be carried is of a substantial size. Most such containers are not large enough to carry the desired amount of food. Furthermore, the size of the container having a sufficient amount of reusable refrigerant to carry a large amount of food, prohibits easy refreezing of the container. It is difficult also to even cool a large reusable container.

Also, with the size of various food containers such as those for salads and similar matters a refrigeratable container becomes too large to handle appropriately. It is desired therefor to provide a refrigeratable means capable of easily being transported while at the same time maintaining the desired cool area for the desired size of the food container.

This is especially in view of the fact of the current trends. The current trends in foods and eating include eating lighter and more natural foods to provide balanced nutrition and lower amounts of added fats and salts. This is clearly a major part of the overall fitness and health trend especially here in the United States.

A primary means of achieving satiaton without overindulging in fats and carbohydrates is to eat perishable, fresh food such as fresh fish, vegetables and fruits that are rich in nutrients and fiber. The fiber provides bulk which makes the consumer feel full, but without adding excess calories. The fiber is also a stimulant to the bodily functions in view of the fact that it is not broken down in the digestive process.

A primary way for deivering these desired foods to a person is in the form of a salad. Other additives can be put into the salad. Meat, fruit, vegetables and other items can be added to a salad. A wide array of fruits and vegetables in a salad provides a complete, pleasing and crisp texture which in turn provides for satisfied chewing. The satisfied chewing increases the enjoyment of the food and encourages consumption of this very healthful food.

Because salads are served in their natural state, the heat or dry air of a household or outdoor picnic can cause wilting and discoloration. This negative factor reduces the physical and nutritional appeal of the food. Chilling is the way to avoid this problem. It is difficult to do however. Furthermore, because salads are often tossed in large containers, it is difficult to store a large container in a refrigerator and keep it cool. It is highly desirable to be able to keep a large container cool in order to preserve the stability of the food to be eaten.

SUMMARY OF THE INVENTION

Accordingly, among the many objects of this invention is to provide a reusable cooling container.

A further objective of this invention is to provide a reusable cooling container having a variable size.

Still a further objective of this invention is to provide a reusable cooling container with a different shapes.

Yet a further objective of this invention is to provide a reusable cooling container to eliminate the need for a portable refrigerated device.

Also an objective of this invention is to provide a reusable cooling container to eliminate the need for a portable electro-mechanical device.

Another objective of this invention is to provide a reusable cooling container to eliminate the need for a disposable refrigerant.

Yet another objective of this invention is to provide a reusable cooling container to eliminate the need for a disposable refrigerant.

Still another objective of this invention is to provide a reusable cooling container of a substantial size.

A further objective of this invention is to provide a reusable cooling container which is easily refrozen or cooled.

Still a further objective of this invention is to provide a reusable cooling container to simplify transport of a large quantity of perishable food.

Yet a further objective of this invention is to provide a reusable cooling container to eliminate the need for a portable refrigerated device.

These and other objectives of this invention are met by providing a reusable cooling device, which may be assembled when used and disassembled and nestable when desired to be refrozen or cooled.

BRIEF DESCRIPTION OF THE DRAWINGS

FIG. 2 depicts a perspective view of a round cooling member 140 for the round cooling device 100 of this invention.

FIG. 8 depicts a perspective view of a round cooling member 140 disassembled from FIG. 2 and arranged in a nestable fashion.

Throughout the figures of the drawing, where the same part appears in more than one figure of the drawing, the same number is applied thereto.

DESCRIPTION OF THE PREFERRED EMBODIMENTS

A coolable device which maintains its cool after refrigeration or freezing is made in any suitable shape or size to achieve the desired results. In a preferred fashion there is a base shape for a cooling member. A plurality of snap on rings may be applied to the base shape in order to make the bowl as deep as desired. The base shaped with the snap on rings can be contained in an insulated bowl and lid to enhance the cooling capability. Additionally, the cooling member can have a liner therein for the salad or other food. The shape can be rectangular or circular, or any other suitable shape. The snap on rings provide for storing and cooling of the refrigerated device preferably in a nestable fashion so that not so much freezer space can be used. This coolable device is also shapeable in the form of a snap together tray with snap together dividers for suitable portions.

Once these desired results are achieved, the refrigeratable device can be of any shape and size and achieve the desired results of keeping large items cool for a desired period of time.

The basis of the cooling device is the cooling member having a sealed hollow container with cooling material sealed therein. The cooling material may be of any type of material which can be repeatedly refrozen or cooled, and then reused. Preferably the cooling material or refrigerant is a glycol gel type material, which can be refrigerated or frozen and hold its cooling for a period of time in spite of exposure to the elements. If this device is further stored in a foamed polystyrene or otherwise insulated container that does not have to be refrigerated, the cooling capabilities of the device are magnified.

Figure 1:
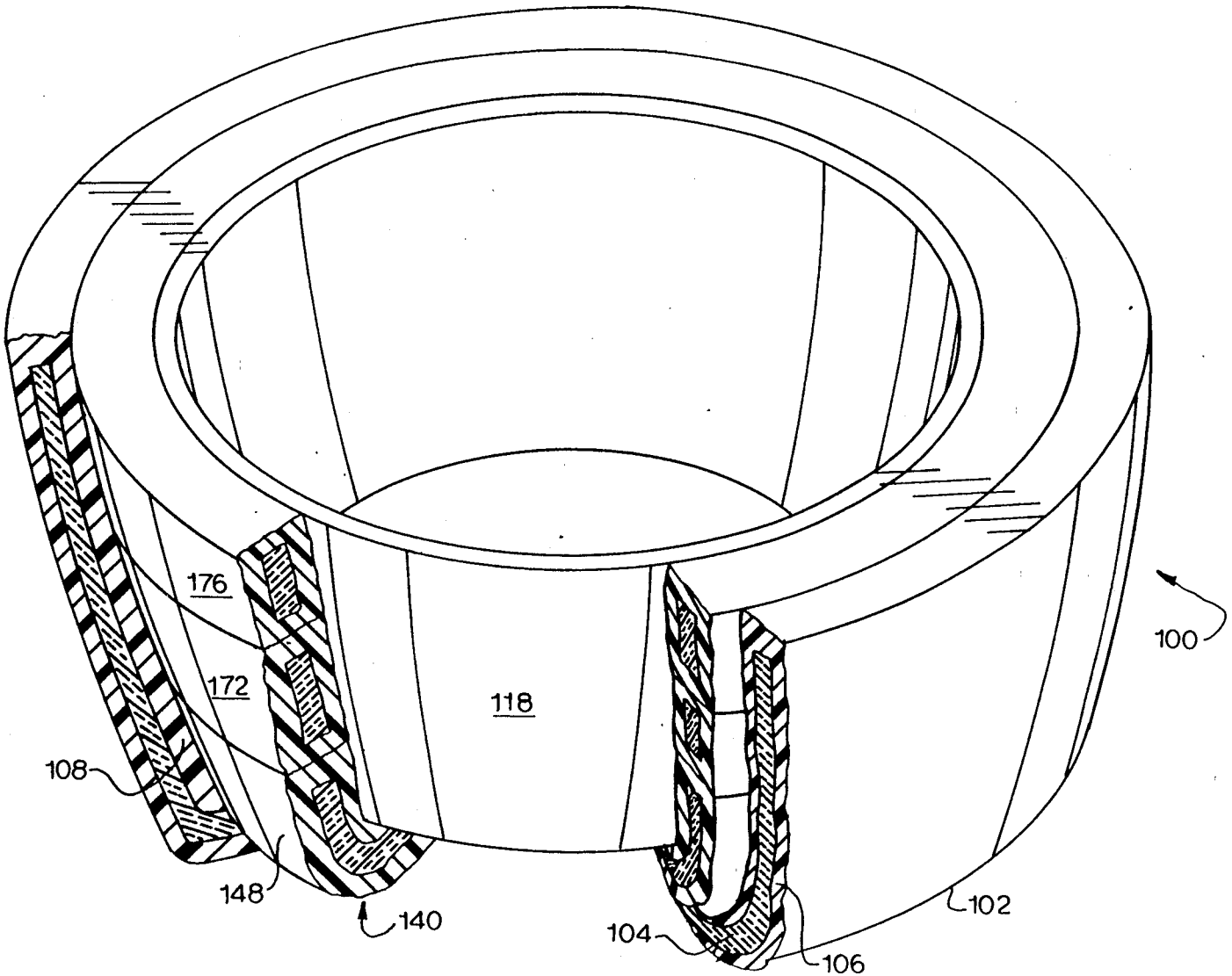
FIG. 1 depicts a perspective view of a round cooling device 100 of this invention in partial cross-section.

Referring now to FIG. 1, the cooling device 100 of this invention includes an outer shell 102 and a cooling member 140. The outer shell 102 preferably includes insulation material 104 such as a foamed polystyrene or similar material. The outer shell 102 contains the insulation material 104 sealed between a first layer 106 and a second layer 108. The first layer 106 is the outer surface of outer shell 102, while the second layer 108 is the inner layer of shell 102 and receives cooling member 140. First layer 106 and second layer 108 are sealed together in a standard fashion containing the insulation material 104 therebetween. First layer 106 and a second layer 108 are made of any foodsafe material suitable for cleaning or reuse.

The cooling member 140 may be used by itself or with outer shell 102 as desired. Outer shell 102 can receive and contain atmospheric condensation from the cooling member 140. Where such condensation is not a problem, outer shell 102 is not required.

Figure 10:
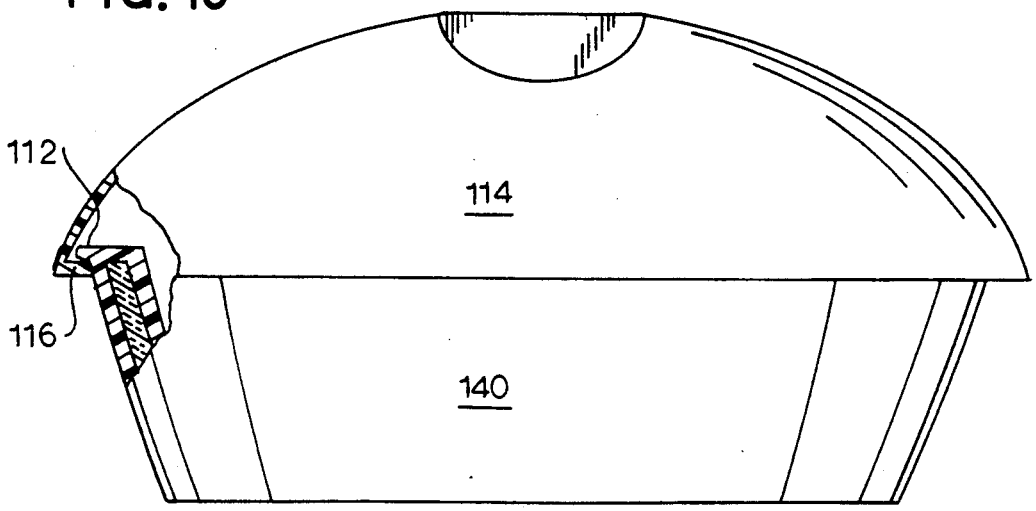
FIG. 10 depicts a partial cross-sectional view a lid 114 for round cooling member 140 of this invention.

Included in the top edge 110 of the outer shell 102 is a shell fastening device 112. Shell fastening device 112 is designed to receive lid 114 to the cover outer shell 102 which is of generally bowl shape as shown in FIG. 1. A standard lid fastening device 116 joins with a standard shell fastening device 112 to removably lock lid 114 on shell 102 as shown in FIG. 10.

Lid 114 may or may not be of a similar insulated structure, as is outer shell 102. The lid 114 may also be insulated as is the outer shell 102. A liner 118 may fit inside cooling member 140 if desired to further minimize food contamination of the cooling member 140. Cooling member 140 is also completely washable and can minimize or eliminate the need for liner 118.

Figure 6:
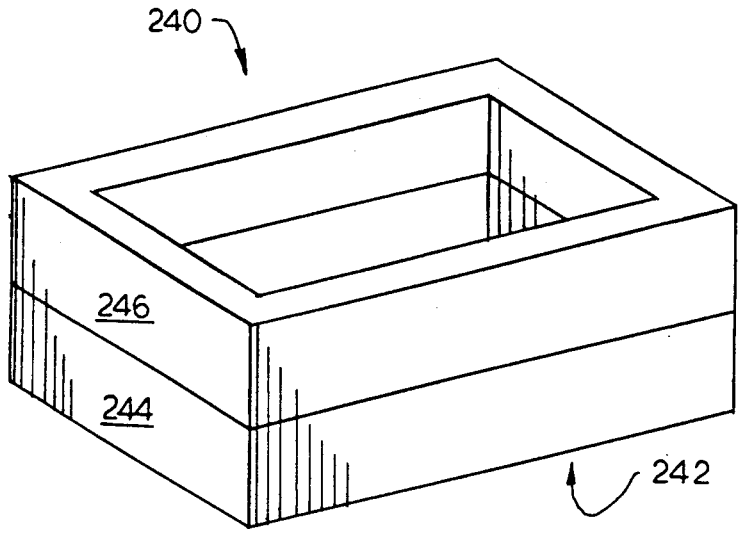
FIG. 6 depicts a perspective view of a rectangular cooling member 240.

Considering FIG. 1 and FIG. 2, designed to fit within the outer shell 102 is an assembled cooling member 140. The assembled cooling member 140 includes a base 148 having sides 152 and a round or circular bottom 154. Of course, the round or circular bottom 154 may be varied to any suitable shape such as shown in FIG. 6 with appropriate adjustment in the sides. The base 148 is formed of an inner reusable refrigerant 150 contained within a suitable packaging material 156 having chamber 158 therein. The base 148 may be refrigerated or frozen for future use. Upon chilling or freezing refrigerant 150 provides the base 148 with the capability of keeping the food cool for a substantial period of time.

The packaging material 156 may be a durable, freezable plastic or other suitable material in the shape of base 148. There is a chamber 158 formed by packaging material 156 to hold refreezable or recoolable refrigerant 150. The base 148 has a round or circular bottom portion 154 with sides 152 extending upwardly from the round bottom portion 154 or other suitable shape. The other suitable shape may be rectangular or any other shape as desired.

First ring 172 and additional ring 176 are similar in structure to base 148. There is a chamber 158 formed by packaging material 156 in the shape of first ring 172 or additional ring to hold refreezable or recoolable refrigerant 150.

Figure 4:
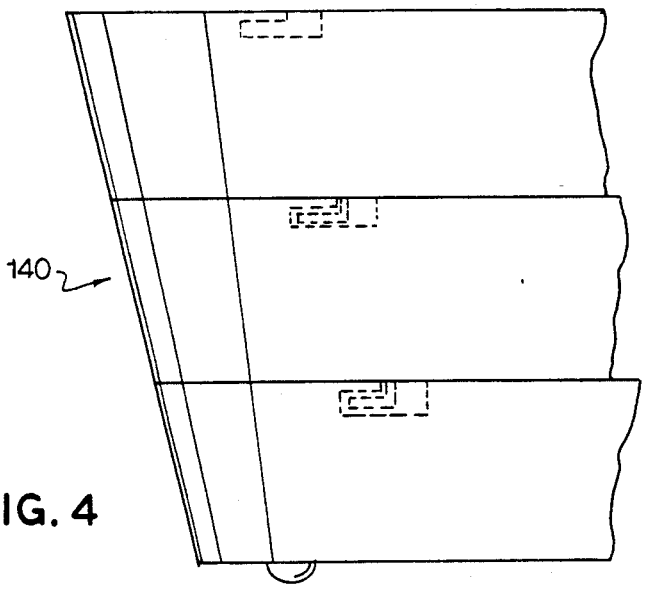
FIG. 4 depicts a partial side view of a round cooling member 140 for the round cooling device 100 of this invention.
Figure 5:
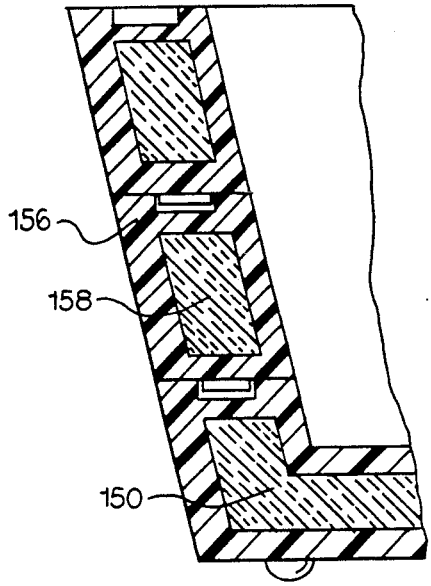
FIG. 5 depicts a partial cross-sectional view of a round cooling member 140 for the round cooling device 100 of this invention.
Figure 3:
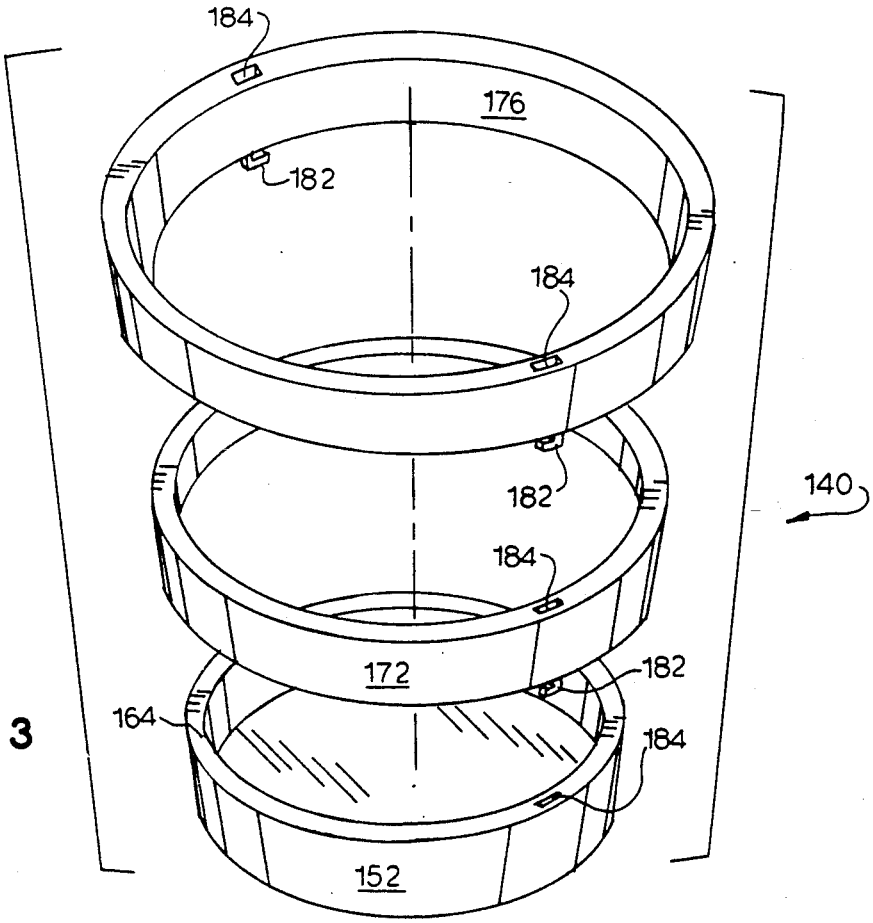
FIG. 3 depicts a perspective, exploded view of a round cooling member 140 for the round cooling device 100 of this invention.

With FIG. 3, FIG. 4, and FIG. 5, contained within the outer shell 102 is the refrigerated cooling member 140. Molded or otherwise in packaging material 156 of base 148, first ring 172 and additional ring 176 is the device for joining them together. On a top base edge 164 of the base 148 is a base snapping mechanism designed to hold a first ring 172 of similar structure to base 148, but without a bottom portion 154. The base snapping mechanism meshes with its counterpart as a ring locking mechanism on the first ring 172 to achieve the desired results of holding the cooling member 140 together, thus resulting in a greater holding volume for cooling member 140 and providing a flexible capacity for cooling device 100. An additional ring 176 or as many of additional ring 176 as desired may be snapped one upon the other to make a cooling member 140 for outer shell 102.

Preferably upon insertion into a freezer or refrigerator the cooling member 140 can be separated into base 148, first ring 172, and additional ring 176, followed by nesting to take up less room in the refrigerator or freezer. On a first side of both first ring 172 and additional ring 176 is a mechanism similar to base snapping mechanism 156, while on a second side of both first ring 172 and additional ring 176 is a mechanism similar to ring locking mechanism 174. In this fashion, the forming of cooling member 140 is possible.

The outer shell 102 of the refrigeration device may be durable and in and of itself form a container or have a liner 118 therein to form the container and provide for holding of the desired food. The separability provides for the nesting and simplified storage or refrigeration. The snap together techniques provide for a bowl of any suitable size to contain a salad or other food. In this fashion, an otherwise perishable food may be maintained for a long time without electro-mechanical refrigeration or disposable refrigerant. In this fashion, the cooling device 100 may be reused repeatedly.

By considering FIG. 3, a preferable snap device 180 between the rings and base includes a male member 182 of a generally L-shaped, which slides into a female member 184 designed to receive the same and lock in place. The male member 182 is slipped into the female member 184 and rotated to form snap device 180. As many of snap device 180 may be used as desired. In this manner, the desired rings may be held together. It is also feasible to make other suitable shapes.

By consideration of FIG. 6, the feasibility of rectangular cooling member 240 becomes clear. Rectangular base 240 has a rectangular bottom 242 and appropriate rectangular sides 244. At least one snap-on unit 246 can vary the size of rectangular cooling member 240 as desired, for example, by using two of unit 246 Snap-on unit 246 is similar in structure to first ring 160. Circular base 148 is similar in structure to rectangular base 240.

Figure 7:
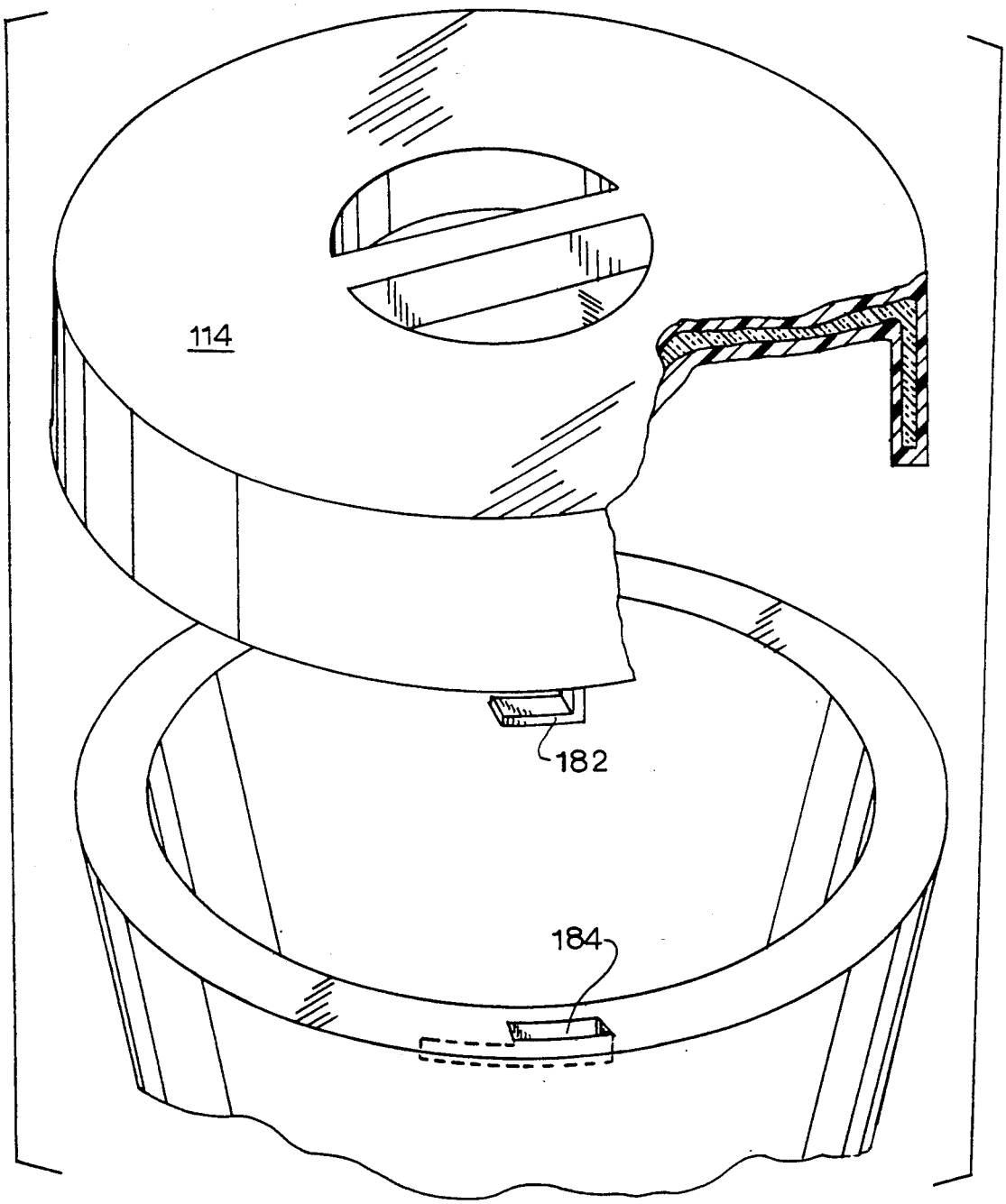
FIG. 7 depicts a perspective, exploded view of a round cooling device 100 with lid 114 of this invention.

In FIG. 7, a lid preferred securing device is shown as a twist locking member. The lid 114 on a circular cooling device 100 includes on the outer thereof at least one male member 182. Preferably, there are at least two of male member 182. There is a matching element for each lid wedge 118 in the form of female member 184 on the top edge 110 thereof. The lid 114 is placed on top edge 110. Upon rotation of lid 114 on top edge 110, each male member 182 locks with female member 184 securing the lid 116 to the outer shell 102.

FIG. 8 depicts a perspective view of a round cooling member 140 disassembled from FIG. 2 and arranged in a nestable fashion. Basically, base 148, first ring 172 and additional ring 176 are separated. First ring 176 is placed inside additional ring 176. Then base 148 is placed inside first ring 172. This nested assembly of cooling member 140 can then be placed in a freezer for chilling and then reused.

Figure 9:
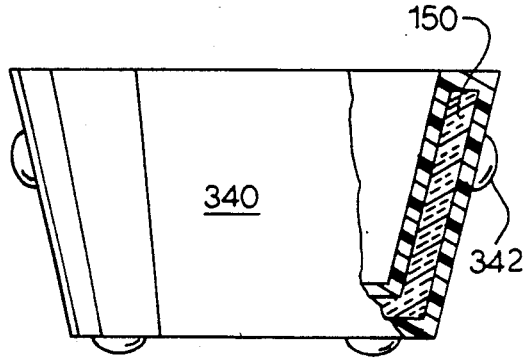
FIG. 9 depicts a partial cross-sectional view of of dip bowl 340 of this invention.

Considering FIG. 9, round dip bowl 340 is modified version of base 148 in outer shell 102 adjusted appropriately for shape. Dip bowl 340 is generally smaller than base 148 and suitable for containing a dipping sauce. Dip bowl 340 may include at least one dip bubble 342 protruding outwardly on the base and sides thereof to form a space between dip bowl 340 and outer shell 102 to permit collection of condensate without damage to the food.

FIG. 10 depicts a partial cross-sectional view of a shell lid 114 for round cooling member 140 of this invention. In this manner, lid fastening device 116 can be shown more clearly, as can insulation 104.

Figure 11:
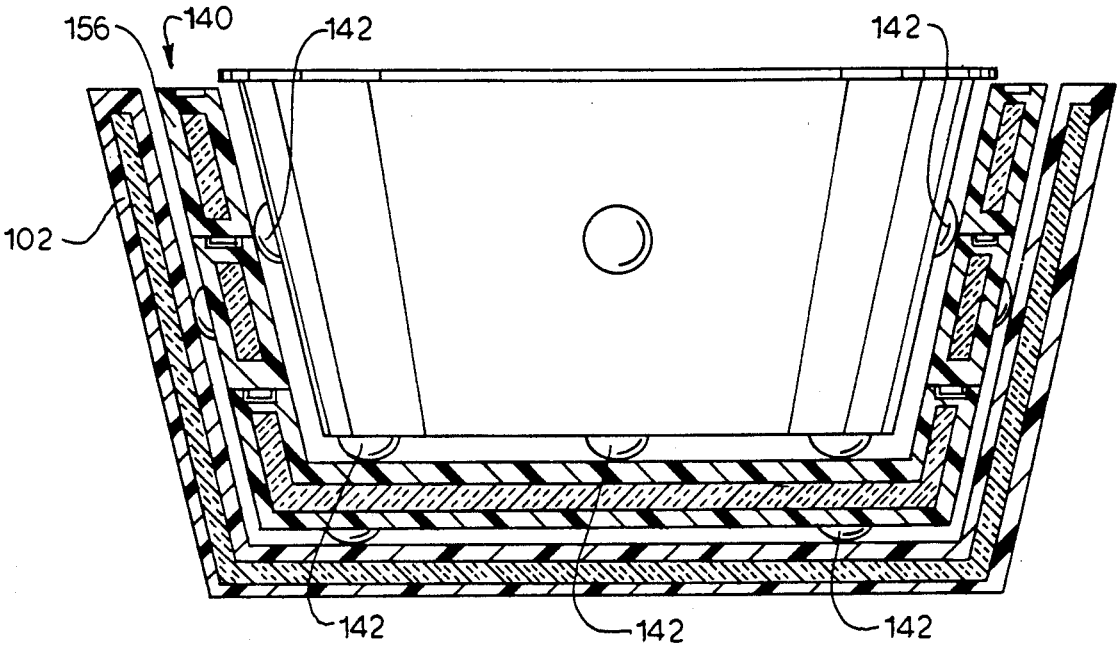
FIG. 11 depicts a side cross-sectional view of a round cooling member 140 in outer shell 102 for the round cooling device 100 of this invention.

FIG. 11 depicts a side cross-sectional view of a round cooling member 140 in outer shell 102 for the round cooling device 100 of this invention. The round cooling member 140 permits condensate to drain into the outer shell 102 by providing spacing bubbles 142 protruding out of the packing material 156. In this fashion, the spacing bubbles 142 are protrusions on the surface of the packing material 156 both interior and exterior thus spacing the cooling member 140 from the liner 118 and from the outer shell 102.

Figure 12:
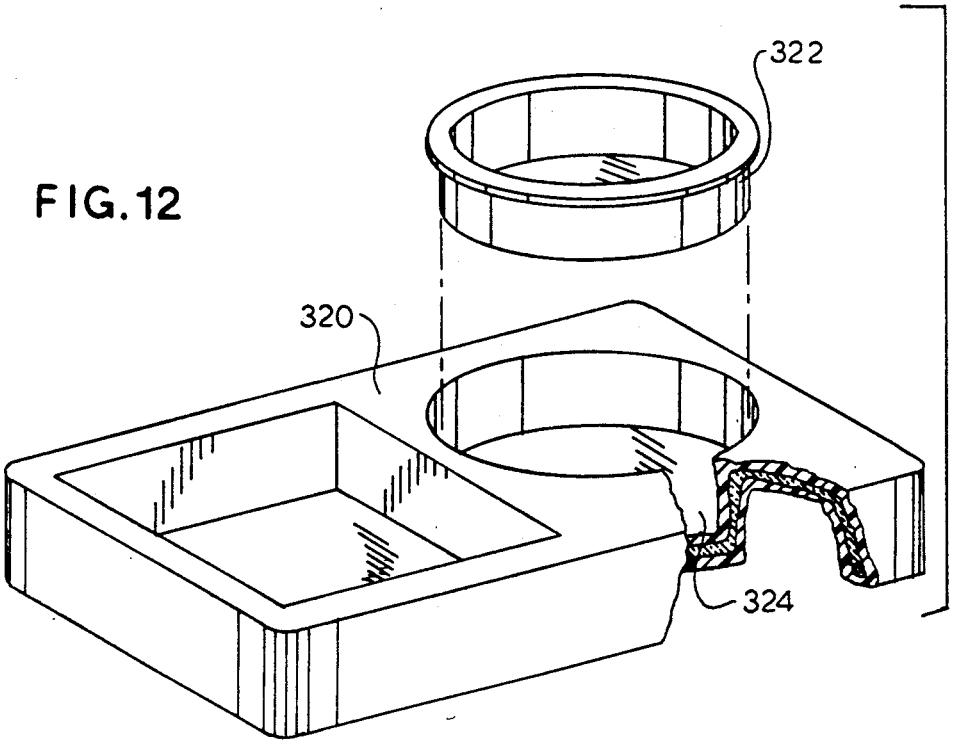
FIG. 12 depicts a partial cross-sectional view of a chambered tray 320 of this invention.

FIG. 12 depicts a chambered tray 320 to receive at least one cup 322 slidably therein for holding a desired food. Chambered tray 320 is similar in structure to flat tray 280, except that a chamber 324 in molded or otherwise shaped in the surface thereof to hold cup 322 or a similar shape slidably mounted therein.

Figure 13:
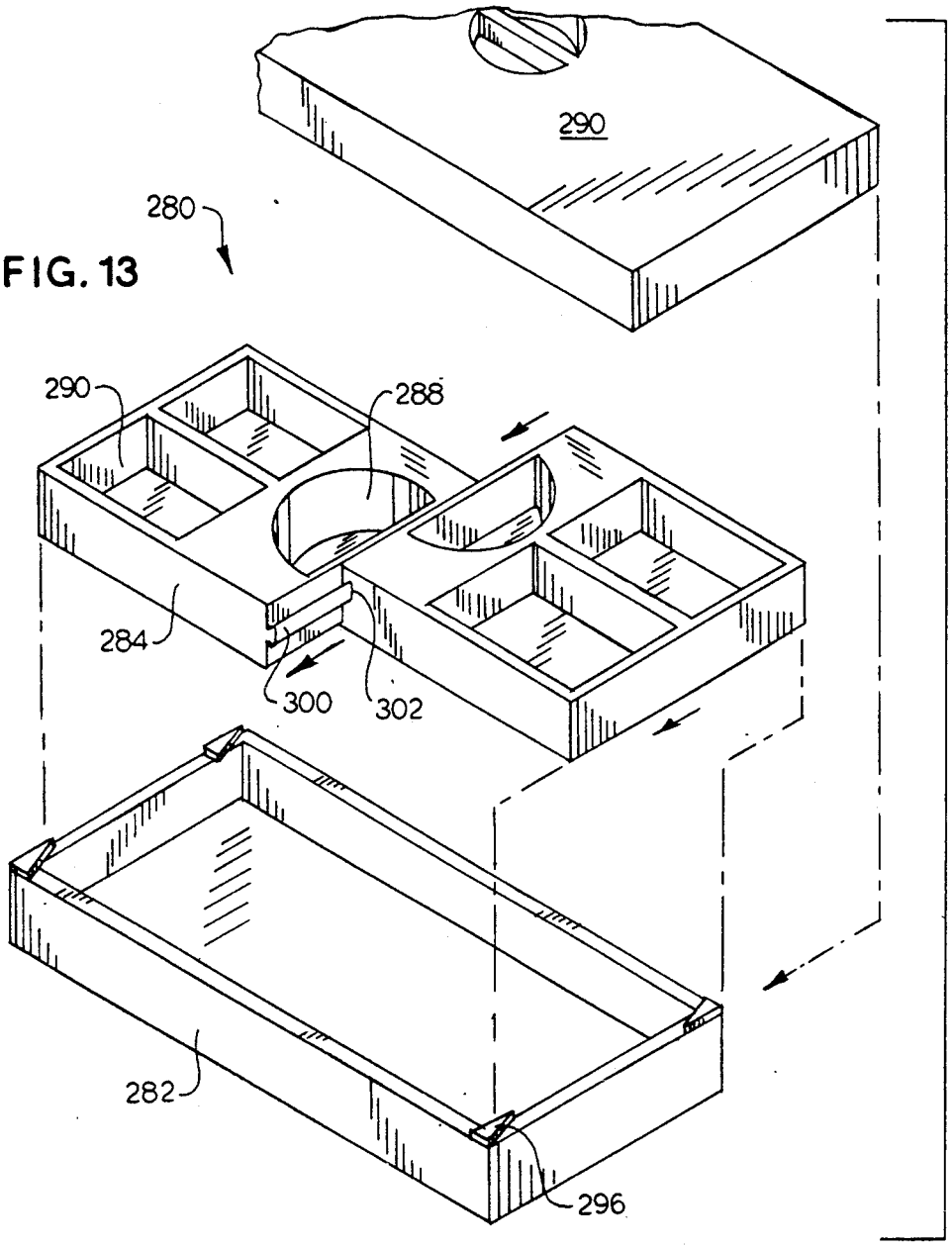
FIG. 13 depicts a perspective, exploded view of a flat tray 280 with tray lid 290 of this invention.
Figure 14:
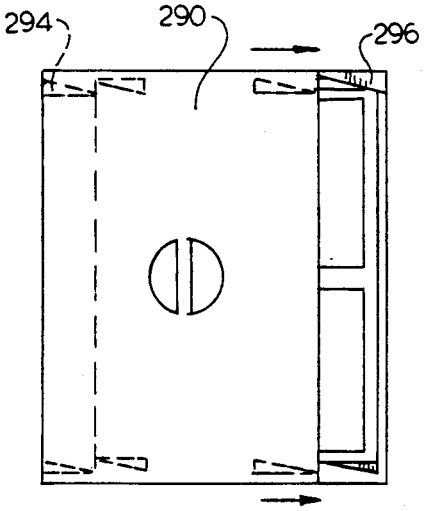
FIG. 14 depicts a top view of a flat tray 280 with tray lid 290 of this invention in a partially open position.

Combining to describe a flat tray 280 with tray lid 290 within the scope of this invention are FIG. 13 and FIG. 14. A tray base 282 receives a first tray member 284 and a second tray member 286. First tray member 284 includes a tongue 300 capable fitting into a groove 302 on second tray member 286 to form flat tray 280 to fit into tray base 282. Both first tray member 284 and second tray member 286 have an interior chamber like chamber 158 to receive refrigerant 150. Also, first tray member 284 and second tray member 286 include desired exterior chambers such as circular chamber 288 and rectangular chamber 290 for holding food. The exterior chambers may have any suitable shape.

FIG. 14 shows tray lid 290 offset with respect to tray base 282. Tray lid slots 294 and tray base slot 296 combine with a sliding movement to removably lock tray lid 290 to tray base 282.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by letters Patent by the United States is:

1. A cooling device, said cooling device having an outer shell, a cooling member to fit said outer shell and a lid for said outer shell, wherein:

a. said cooling member includes a base member and at least one ring member removably secured to said base member;
b. said base member includes at least one side member and a bottom member;
c. said bottom member is an integral part of said side member at a first edge of said side member;
d. said ring member includes a ring fastening means to removably secure said ring member to a second edge of said side member;
e. said first edge is oppositely disposed from said second edge of said side member;
f. said base member includes a base hollow portion throughout;
g. said ring member includes a ring hollow portion throughout; and
h. said base hollow portion and said ring hollow portion contain a reusable refrigerant therein.

2. The cooling device of claim 1, wherein:

a. said outer shell includes insulation material;
b. said outer shell contains said insulation material sealed between a first layer and a second layer;
c. said first layer is an outer surface of said outer shell;
d. said second layer is an inner surface of said outer shell; and
e. said second layer receives said cooling member.

3. The cooling device of claim 1, wherein said cooling member is used alone.

4. The cooling device of claim 1, wherein said base member is used alone.

5. The cooling device of claim 1, wherein:
a. said outer shell includes a top edge;
b. said top edge includes a shell fastening device;
c. said outer shell is removably closable with a lid; and
d. said lid includes a lid fastening device capable of joining with said shell fastening device to secure said lid to said outer shell.

6. The cooling device of claim 5, wherein:
a. said cooling device has a substantially round cross-section; and
b. said top edge shell fastening device and said lid fastening device combine to form a twist locking device.

7. The cooling device of claim 1, wherein:
a. said base member includes at least one female fastening member on a top base edge thereof;
b. said ring member includes at least one L-shaped male fastening member on a first ring edge;
c. a number of said female fastening member is substantially equal to a number of said L-shaped male fastening members and
d. a twisting motion serves to removably lock said L-shaped male fastening member into said female fastening member.

8. The cooling device of claim 1, wherein:
a. said ring member includes at least one female fastening member on a second ring edge; and
b. said first ring edge is oppositely disposed from said second ring edge.

9. The cooling device of claim 1, wherein:
a. said base member includes at least one L-shaped male fastening member on a top base edge thereof;
b. said ring member includes at least one female fastening member on a first ring edge;
c. a number of said female fastening member is substantially equal to a number of said L-shaped male fastening; and
d. a twisting motion serves to removably lock said L-shaped male fastening member into said female fastening member.

10. The cooling device of claim 1, wherein said base member and said ring member are nestable when separated.

11. The cooling device of claim 10, wherein:
a. said outer shell includes insulation material;
b. said outer shell contains said insulation material sealed between a first layer and a second layer;
c. said first layer is an outer surface of said outer shell;
d. said second layer is an inner surface of said outer shell; and
e. said second layer receives said cooling member.

12. The cooling device of claim 1, wherein:
a. said base member is a rectangular base member;
b. said ring member is a rectangular ring member;
c. said outer shell is a rectangular outer shell;
d. said ring member and said outer shell are adapted to fit said rectangular base member; and
e. a rectangular lid for said rectangular outer shell includes a slide locking mechanism to secure said rectangular lid to said rectangular outer shell.

* * * * *